US009845922B2

(12) United States Patent
van de Ven et al.

(10) Patent No.: US 9,845,922 B2
(45) **Date of Patent: *Dec. 19, 2017**

(54) LED LAMP WITH HIGH COLOR RENDERING INDEX

(71) Applicant: Cree, Inc., Durham, NC (US)

(72) Inventors: Antony Paul van de Ven, Hong Kong (CN); Gerald H. Negley, Chapel Hill, NC (US); Dong Lu, Cary, NC (US)

(73) Assignee: Cree, Inc., Durham, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/268,891

(22) Filed: Sep. 19, 2016

(65) Prior Publication Data

US 2017/0016583 A1 Jan. 19, 2017

Related U.S. Application Data

(63) Continuation of application No. 14/702,176, filed on May 1, 2015, now Pat. No. 9,458,971, which is a (Continued)

(51) Int. Cl.
*F21K 2/00* (2006.01)
*F21V 13/00* (2006.01)
(Continued)

(52) U.S. Cl.
CPC ..... *F21K 9/232* (2016.08); *F21K 9/23* (2016.08); *F21K 9/235* (2016.08); *F21K 9/237* (2016.08);
(Continued)

(58) Field of Classification Search
CPC ... F21V 3/02; F21K 9/232; F21K 9/62; F21K 9/23; F21K 9/90; F12K 9/237
See application file for complete search history.

(56) References Cited

U.S. PATENT DOCUMENTS 3,581,162 A 5/1971 Wheatley
5,463,280 A 10/1995 Johnson
(Continued)

FOREIGN PATENT DOCUMENTS

CN 201373273 Y 12/2009
CN 101821544 A 9/2010
(Continued)

OTHER PUBLICATIONS

Mexican Patent Office; Mexican Application No. MX/a/2013/007272, Office Action dated Sep. 3, 2014, 5 pages.
(Continued)

*Primary Examiner* — Karabi Guharay
(74) *Attorney, Agent, or Firm* — Dennis J. Williamson; Moore & Van Allen PLLC

(57) ABSTRACT

An LED lamp with a high color rendering index (CRI) is disclosed. Example embodiments of the invention provide an LED lamp with a relatively high color rendering index (CRI). In some embodiments, the lamp has other advantageous characteristics, such as good angular uniformity. In some embodiments, the LED lamp is sized and shaped as a replacement for a standard incandescent bulb, and includes an LED assembly with at least first and second LEDs operable to emit light of two different colors. In some embodiments, the lamp can emit light with a color rendering index (CRI) of at least 90 without remote wavelength conversion. In some embodiments, the LED lamp conforms some, most, or all of the product requirements for a 60-watt incandescent replacement for the L prize.

20 Claims, 10 Drawing Sheets

Related U.S. Application Data continuation of application No. 12/975,820, filed on Dec. 22, 2010, now Pat. No. 9,052,067.

(51) Int. Cl.

| | |
|---|---|
| ***F21K 9/232*** | (2016.01) |
| ***F21V 23/02*** | (2006.01) |
| ***F21V 29/51*** | (2015.01) |
| ***F21V 3/04*** | (2006.01) |
| ***F21K 9/90*** | (2016.01) |
| ***F21V 7/04*** | (2006.01) |
| ***F21V 3/02*** | (2006.01) |
| ***F21V 29/77*** | (2015.01) |
| ***F21V 29/83*** | (2015.01) |
| ***F21K 9/23*** | (2016.01) |
| ***F21K 9/62*** | (2016.01) |
| ***F21K 9/272*** | (2016.01) |
| ***F21K 9/66*** | (2016.01) |
| ***F21K 9/238*** | (2016.01) |
| ***F21K 9/235*** | (2016.01) |
| ***F21K 9/237*** | (2016.01) |
| *F21V 7/00* | (2006.01) |
| *F21Y 101/00* | (2016.01) |
| *F21Y 105/10* | (2016.01) |
| *F21Y 115/10* | (2016.01) |
| *F21Y 113/13* | (2016.01) |
| *F21K 9/68* | (2016.01) |

(52) U.S. Cl.

CPC ..... *F21K 9/238* (2016.08); *F21K 9/272* (2016.08); *F21K 9/62* (2016.08); *F21K 9/66* (2016.08); *F21K 9/90* (2013.01); *F21V 3/02* (2013.01); *F21V 3/04* (2013.01); *F21V 7/041* (2013.01); *F21V 23/02* (2013.01); *F21V 29/51* (2015.01); *F21V 29/773* (2015.01); *F21V 29/83* (2015.01); *F21K 9/68* (2016.08); *F21V 7/0016* (2013.01); *F21Y 2101/00* (2013.01); *F21Y 2105/10* (2016.08); *F21Y 2113/13* (2016.08); *F21Y 2115/10* (2016.08); *Y10T 29/49002* (2015.01); *Y10T 29/49119* (2015.01)

(56) References Cited

U.S. PATENT DOCUMENTS

| | | | |
|---|---|---|---|
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |
| 6,227,679 | B1 | 5/2001 | Zhang et al. |
| 6,234,648 | B1 | 5/2001 | Borner et al. |
| 6,250,774 | B1 | 6/2001 | Begemann et al. |
| 6,276,822 | B1 | 8/2001 | Bedrosian et al. |
| 6,465,961 | B1 | 10/2002 | Cao |
| 6,523,978 | B1 | 2/2003 | Huang |
| 6,550,953 | B1 | 4/2003 | Takahashi et al. |
| 6,634,770 | B2 | 10/2003 | Cao |
| 6,659,632 | B2 | 12/2003 | Chen |
| 6,709,132 | B2 | 3/2004 | Ishibashi |
| 6,803,607 | B1 | 10/2004 | Chan et al. |
| 6,848,819 | B1 | 2/2005 | Arndt et al. |
| 6,864,513 | B2 | 3/2005 | Lin et al. |
| 6,948,829 | B2 | 9/2005 | Verdes et al. |
| 6,982,518 | B2 | 1/2006 | Chou et al. |
| 7,048,412 | B2 | 5/2006 | Martin et al. |
| 7,080,924 | B2 | 7/2006 | Tseng et al. |
| 7,086,756 | B2 | 8/2006 | Maxik |
| 7,086,767 | B2 | 8/2006 | Sidwell et al. |
| 7,144,135 | B2 | 12/2006 | Martin et al. |
| 7,165,866 | B2 | 1/2007 | Li |
| 7,172,314 | B2 | 2/2007 | Currie et al. |
| 7,213,940 | B1 | 5/2007 | Van De Ven et al. |
| 7,354,174 | B1 | 4/2008 | Yan |
| 7,396,142 | B2 | 7/2008 | Laizure, Jr. et al. |
| 7,600,882 | B1 | 10/2009 | Morejon et al. |
| 7,663,315 | B1 | 2/2010 | Hulse |
| 7,686,478 | B1 | 3/2010 | Hulse et al. |
| 7,726,836 | B2 | 6/2010 | Chen |
| 7,824,065 | B2 | 11/2010 | Maxik |
| 8,021,025 | B2 | 9/2011 | Lee |
| 8,253,316 | B2 | 8/2012 | Sun et al. |
| 8,272,762 | B2 | 9/2012 | Maxik et al. |
| 8,274,241 | B2 | 9/2012 | Guest et al. |
| 8,277,082 | B2 | 10/2012 | Dassanayake et al. |
| 8,282,250 | B1 | 10/2012 | Dassanayake et al. |
| 8,292,468 | B2 | 10/2012 | Narendran et al. |
| 8,322,896 | B2 | 12/2012 | Falicoff et al. |
| 8,360,615 | B2 | 1/2013 | Rizkin et al. |
| 8,371,722 | B2 | 2/2013 | Carroll |
| 8,400,051 | B2 | 3/2013 | Hakata et al. |
| 8,415,865 | B2 | 4/2013 | Liang et al. |
| 8,421,320 | B2 | 4/2013 | Chuang |
| 8,421,321 | B2 | 4/2013 | Chuang |
| 8,421,322 | B2 | 4/2013 | Carroll et al. |
| 8,449,154 | B2 | 5/2013 | Uemoto et al. |
| 8,502,468 | B2 | 8/2013 | Li et al. |
| 8,598,809 | B2 | 12/2013 | Negley et al. |
| 8,641,237 | B2 | 2/2014 | Chuang |
| 8,653,723 | B2 | 2/2014 | Cao et al. |
| 8,696,168 | B2 | 4/2014 | Li et al. |
| 8,740,415 | B2 | 6/2014 | Wheelock |
| 8,750,671 | B1 | 6/2014 | Kelly et al. |
| 8,752,984 | B2 | 6/2014 | Lenk et al. |
| 8,760,042 | B2 | 6/2014 | Sakai et al. |
| 9,052,067 | B2 * | 6/2015 | van de Ven ..... F21V 3/02 |
| 9,458,971 | B2 * | 10/2016 | van de Ven ..... F21V 3/02 |
| 2004/0201990 | A1 | 10/2004 | Meyer |
| 2007/0223219 | A1 | 9/2007 | Medendorp, Jr. et al. |
| 2009/0161356 | A1 | 6/2009 | Negley et al. |
| 2009/0184618 | A1 | 7/2009 | Hakata et al. |
| 2010/0207502 | A1 | 8/2010 | Cao et al. |
| 2010/0254127 | A1 | 10/2010 | Yang |
| 2010/0301353 | A1 | 12/2010 | Pabst et al. |
| 2011/0080740 | A1 | 4/2011 | Allen et al. |
| 2011/0089838 | A1 | 4/2011 | Pickard et al. |
| 2011/0115390 | A1 | 5/2011 | Ku et al. |
| 2011/0198984 | A1 | 8/2011 | Van De Ven |
| 2011/0216523 | A1 | 9/2011 | Tong et al. |
| 2012/0040585 | A1 | 2/2012 | Huang |
| 2012/0075833 | A1 | 3/2012 | Le et al. |
| 2015/0330581 | A1 | 11/2015 | Van De Ven et al. |

FOREIGN PATENT DOCUMENTS

| | | | |
|---|---|---|---|
| DE | 102007056874 | A1 | 5/2009 |
| EP | 1058221 | A2 | 12/2000 |
| EP | 0890059 | B1 | 6/2004 |
| GB | 2345954 | A | 7/2000 |
| JP | H09265807 | A | 10/1997 |
| JP | 2000173304 | A | 6/2000 |
| JP | 2001118403 | A | 4/2001 |
| JP | 2010199144 | A | 9/2010 |
| WO | 0124583 | A1 | 4/2001 |
| WO | 0160119 | A2 | 8/2001 |
| WO | 2009049019 | A1 | 4/2009 |
| WO | 2010128419 | A1 | 11/2010 |
| WO | 2012011279 | A1 | 1/2012 |
| WO | 2012031533 | A1 | 3/2012 |

OTHER PUBLICATIONS

Taiwan Patent Office, Taiwan Application No. 100107050, Office Action dated Jun. 27, 2014, 28 pages.

(56) References Cited

OTHER PUBLICATIONS

Cree, Inc., International Patent Application No. PCT/US2011/026791, International Search Report and Written Opinion dated May 13, 2011, 10 pages.
U.S. Department of Energy, "Bright Tomorrow Lighting Competition (L Prize™)", Jun. 26, 2009, Revision 1, 18 pages.
Osram Sylvania, "Osram Sylvania Introduces LED Replacement for 60W Lamp," Press Release, May 12, 2010 with photos from Dec. 9, 2010, 4 pages.
ANSI, "American National Standard for Electric Lamps," ANSI C78.20-2003, 48 pages.
Energy Star, "Energy Star Program Requirements for Integral LED Lamps Partner Commitments," Amended Mar. 22, 2010, 30 pages.
Taiwan Patent Office, Taiwan Application No. 100107050, Office Action dated Mar. 12, 2015, 9 pages.
U.S. Appl. No. 14/702,176, Office Action, dated Oct. 7, 2015.
U.S. Appl. No. 14/702,176, Final Office Action, dated Feb. 19, 2016.
U.S. Appl. No. 12/975,820, Office Action, dated Jan. 3, 2013.
U.S. Appl. No. 12/975,820, Final Office Action, dated Mar. 20, 2013.
U.S. Appl. No. 12/975,820, Office Action, dated Aug. 2, 2013.
U.S. Appl. No. 12/975,820, Office Action, dated Jan. 9, 2014.
U.S. Appl. No. 12/975,820, Final Office Action, dated Jun. 9, 2014.
U.S. Appl. No. 12/975,820, Office Action, dated Sep. 11, 2014.

* cited by examiner

LED LAMP WITH HIGH COLOR RENDERING INDEX

CROSS-REFERENCE TO RELATED APPLICATIONS

This application is a continuation of and claims priority from commonly-owned U.S. patent application Ser. No. 14/702,176, filed May 1, 2015, now U.S. Pat. No. 9,458,971, which is a continuation of and claims priority from commonly-owned U.S. patent application Ser. No. 12/975,820, filed Dec. 22, 2010, now U.S. Pat. No. 9,052,067, the entire disclosures of both of which are incorporated herein by reference.

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in red-blue-green arrays that can be controlled to deliver virtually any color light, and contain no lead or mercury. In many applications, one or more LED dies (or chips) are mounted within an LED package or on an LED module, which may make up part of a lighting unit, lamp, "light bulb" or more simply a "bulb," which includes one or more power supplies to power the LEDs. An LED bulb may be made with a form factor that allows it to replace a standard threaded incandescent bulb, or any of various types of fluorescent lamps.

Color reproduction can be an important characteristic of any type of artificial lighting, including LED lighting. Color reproduction is typically measured using the color rendering index (CRI). The CRI is a relative measurement of how the color rendition of an illumination system compares to that of a theoretical blackbody radiator. In practical terms, the CRI is a relative measure of the shift in surface color of an object when lit by a particular lamp. The CRI equals 100 if the color coordinates of a set of test surfaces being illuminated by the lamp are the same as the coordinates of the same test surfaces being irradiated by the theoretical blackbody radiator. Daylight has the highest CRI (100), with incandescent bulbs being relatively close (about 95), and fluorescent lighting being less accurate (70-85). Certain types of specialized lighting, such as mercury vapor and sodium lights exhibit a relatively low CRI (as low as about 40 or even lower).

Angular uniformity, also referred to as luminous intensity distribution, is also important for LED lamps that are to replace standard incandescent bulbs. The geometric relationship between the filament of a standard incandescent bulb and the glass envelope, in combination with the fact that no electronics or heat sink is needed, allow light from an incandescent bulb to shine in a relatively omnidirectional pattern. That is, the luminous intensity of the bulb is distributed relatively evenly across angles in the vertical plane for a vertically oriented bulb from the top of the bulb to the screw base, with only the base itself presenting a significant light obstruction. LED bulbs typically include electronic circuitry and a heat sink, which may obstruct the light in some directions.

In some locales, government, non-profit and/or educational entities have established standards for SSL products, and provided incentives such as financial investment, grants, loans, and/or contests in order to encourage development and deployment of SSL products meeting such standards to replace common lighting products currently used. Color parameters are typically part of such standards because pleasing color is important to consumer acceptance of alternative lighting products. Luminous intensity distribution is also typically part of such standards. For example, in the United States, the Bright Tomorrow Lighting Competition (L Prize™) has been authorized by the Energy Independence and Security Act of 2007 (EISA). The L Prize is described in *Bright Tomorrow Lighting Competition* (*L Prize*™), Jun. 26, 2009, Document No. 08NT006643, the disclosure of which is hereby incorporated herein by reference. The L Prize winner's product must conform to many requirements, including, but not limited to those related to color and luminous intensity distribution.

SUMMARY

Example embodiments of the invention provide an LED lamp with a relatively high color rendering index (CRI). In some embodiments, the lamp has other advantageous characteristics. In some embodiments, the LED lamp is sized and shaped as a replacement for a standard omnidirectional incandescent bulb, and includes an LED assembly with at least first and second LEDs operable to emit light of at least two different colors. In some embodiments, the lamp has an Edison base and is sized and shaped to act as a replacement for a standard "A19" bulb. In some embodiments, the lamp also includes an enclosure configured so that light from the LED assembly, when the LEDs are energized, passes through the enclosure without remote wavelength conversion and is emitted with a CRI of at least 90. In such an embodiment, the light from the LED assembly passes through the enclosure without remote wavelength conversion because there is no remote lumiphor, such as a phosphor dome in the lamp, although such a wavelength conversion material may be included in the LED packages or elsewhere in the LED assembly. As used herein, wavelength conversion material refers to a material that is excited by a photon of a first wavelength and emits photons of a second, different wavelength.

In some embodiments, the enclosure includes a color mixing treatment. In some embodiments, the color mixing treatment can include two sections with differing transmittance-to-reflectance ratios. In some embodiments, the lamp includes a conical reflective surface disposed between the LED assembly and the power supply for the lamp. In some embodiments, the lamp included a cone reflector disposed above the LED assembly within the enclosure. In some embodiments, a thermal post is disposed between the LED assembly and the power supply. The thermal post may have an optically optimized surface outside the post, either on the post itself, or as a separate part. In some embodiments, a heat pipe may be disposed between the LED assembly and the power supply. In some embodiments, the enclosure may have a substantially transparent section opposite the conical reflective surface, thermal post or heat pipe, as the case may be.

In some embodiments, an omnidirectional LED lamp has a correlated color temperature (CCT) from about 1200K to 3500K. In various embodiments, the LED lamp can have a luminous efficacy of at least 100 lumens per watt, at least 90 lumens per watt, at least 75 lumens per watt, or at least 50 lumens per watt. In some embodiments, the LED lamp has a luminous intensity distribution that varies by not more than 10% from 0 to 150 degrees from the top of the lamp. In some embodiments, the lamp has a luminous intensity distribution that varies by not more than 20% from 0 to 135 degrees. In some embodiments, at least 5% of the total flux from the lamp is in the 135-180 degree zone. In some embodiments, the lamp has a luminous intensity distribution that varies by not more than 30% from 0 to 120 degrees. In some embodiments, the LED lamp has a color spatial uniformity of such that chromaticity with change in viewing angle varies by no more than 0.004 from a weighted average point. In some embodiments, the LED lamp conforms to the product requirements for luminous efficacy, color spatial uniformity, light distribution, color rendering index, dimensions and base type of a 60-watt incandescent replacement for the L prize.

In some embodiments of the invention, the LED assembly includes LED packages emitting blue-shifted yellow and red/orange light. In some embodiments, the LED assembly of the LED lamp includes an LED array with at least two groups of LEDs, wherein one group, if illuminated, would emit light having dominant wavelength from 440 to 480 nm, and another group, if illuminated, would emit light having a dominant wavelength from 605 to 630 nm. In some embodiments LEDs in one group are packaged with a lumiphor, which, when excited, emits light having a dominant wavelength from 560 to 580 nm. In some embodiments, one group of LEDs is arranged in two strings with the other group of LEDs arranged in a single string between the two strings.

In some embodiments one group of LEDs, if illuminated, would emit light having dominant wavelength from 435 to 490 nm, and another group, if illuminated, would emit light having a dominant wavelength from 600 to 640 nm. In some embodiments LEDs in one group are packaged with a lumiphor, which, when excited, emits light having a dominant wavelength from 540 to 585 nm.

An LED lamp according to some embodiments of the invention can be assembled by providing the LEDs operable to emit light of two different colors and packaging LEDs, including a lumiphor for at least some of the LEDs, to produce the LED assembly. The LED assembly can then be connected to the power supply and the color mixing enclosure can be installed. A support for the LED assembly, such as a conical reflective surface, a thermal post or a heat pipe can be provided, and in such embodiments, the LED assembly can be connected to the power supply through the support.

BRIEF DESCRIPTION OF THE DRAWINGS

FIG. 1A is a perspective view of the lamp with the color mixing enclosure removed so that the LED assembly is visible. FIG. 1B is a cross-sectional view of the same lamp with the color mixing enclosure in place.

DETAILED DESCRIPTION

The following detailed description refers to the accompanying drawings, which illustrate specific embodiments of the invention. Other embodiments having different structures and operation do not depart from the scope of the present invention.

Embodiments of the invention are described with reference to drawings included herewith. Like reference numbers refer to like structures throughout. It should be noted that the drawings are schematic in nature. Not all parts are always shown to scale. The drawings illustrate but a few specific embodiments of the invention.

Figure 1A:
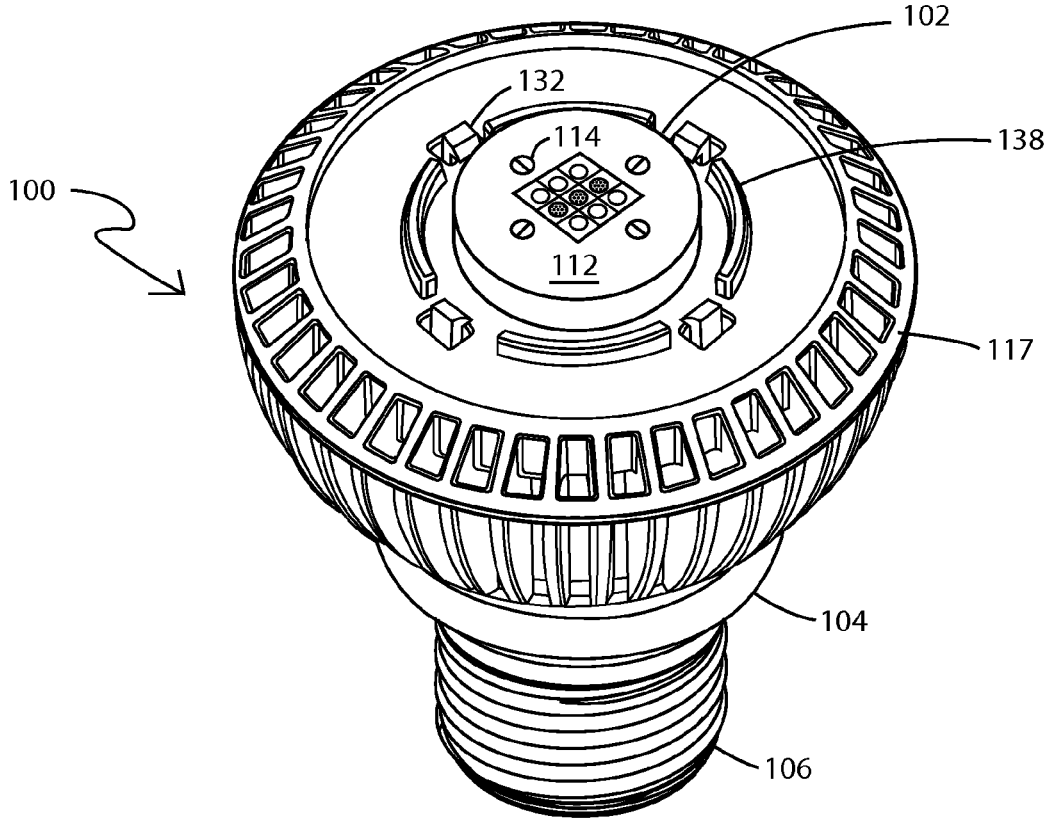
FIGS. 1A and 1B show two different views of an LED lamp according to an example embodiment of the invention.
Figure 1B:
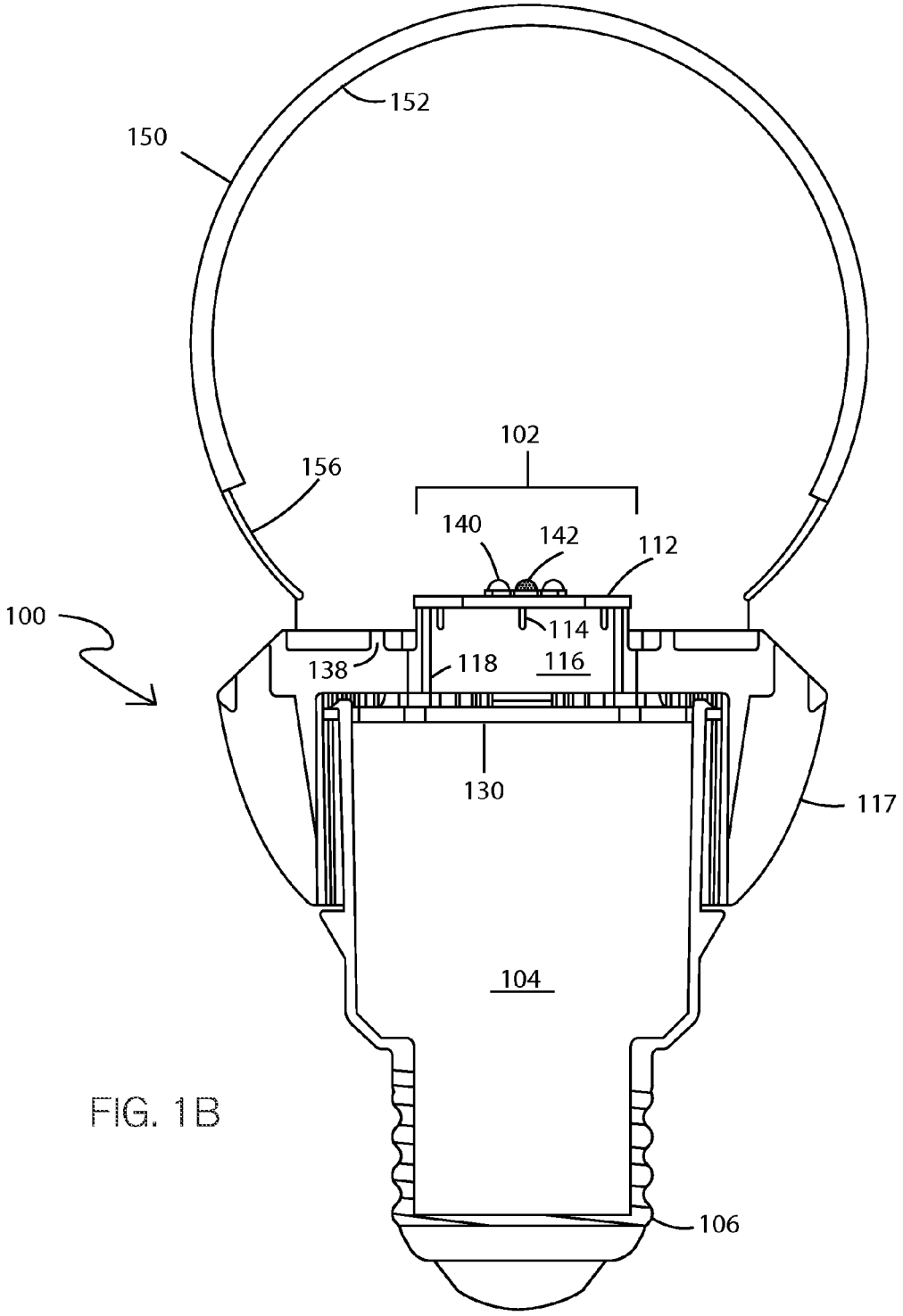

FIGS. 1A and 1B show two views of the partially assembled lamp according to embodiments of the present invention. FIG. 1A is a perspective view of lamp 100 with the color mixing, domed enclosure removed and FIG. 1B is side view of the complete lamp shown in as a partial cross section. In the case of FIGS. 1A and 1B, LED assembly 102 of the lamp has been interconnected with power supply portion 104 of the lamp. The power supply portion 104 of the lamp includes a power supply consisting of circuitry (not visible) to provide DC current to an LED assembly. To assemble the power supply portion of the lamp, the circuitry is installed within the void in the power supply portion and potted, or covered with a resin to provide mechanical and thermal stability. The potting material fills the space within power supply portion 104 not occupied by power supply components and connecting wires.

The particular power supply portion of an LED lamp shown in FIGS. 1A and 1B includes an Edison base, 106, and the lamp may be shaped and size to act as a replacement for a standard "A19" bulb. The Edison base can engage with an Edison socket so that this example LED lamp can replace a standard incandescent bulb. The electrical terminals of the Edison base are connected to the power supply to provide AC power to the power supply. The particular physical appearance of the power supply portion and type of base included are examples only. Numerous types of LED lamps can be created using embodiments of the invention, with various types of bases, cooling mechanisms and shapes. A19 and other bulbs are described in American National Standard ANSI C78.20-2003 for electric lamps, *A, G, PS, and Similar Shapes with E26 Screw Bases*, Oct. 30, 2003, which is incorporated herein by reference.

Staying with FIGS. 1A and 1B, LED assembly 102 further includes multiple LED modules mounted on a carrier such as circuit board 112, which provides both mechanical support and electrical connections for the LEDs. In the example embodiment of FIGS. 1A and 1B, the LED assembly is held in place with screws 114 that screw the LED assembly onto pedestal 116, which is formed in heat sink 117. Voids 118 in the sides of the pedestal allow wires from the power supply to be connected to LED assembly 102.

In the case of FIGS. 1A and 1B, heat sink 117 has been interconnected with a thermal isolation device 130, which is in turn interconnected with power supply portion 104 of the lamp. Tabs 132 of the thermal isolation device engage corresponding slots 134 in the heat sink 117 of the lamp. Curved ridges 138 provide additional mechanical stability and may define a space in which an optical enclosure for the lamp can rest. It should be noted that the heat sink design can vary. A heat sink may be used that has more extended curved fins, more or fewer fins, etc. A heat sink may be provided that has a more decorative appearance. Optional thermal isolation device 130 can be used to keep heat from the LED assembly from excessively raising the temperature of the power supply components. An example thermal isolation device is described in pending U.S. patent application Ser. No. 12/889,719, filed Sep. 24, 2010, the entire disclosure of which is incorporated herein by reference.

Still referring to FIGS. 1A and 1B, LED assembly 102 in this example embodiment includes nine LED packages or LED modules, in which an LED chip is encapsulated inside a package with a lens and leads. Each LED module is mounted in circuit board 112. The LED modules include LEDs operable to emit light of two different colors. In this example embodiment, the LED modules 140 on the LED assembly in the lamp of FIGS. 1A and 1B include a group of LEDs, wherein each LED, when illuminated, emits light having dominant wavelength from 440 to 480 nm. The LED modules 142 on the LED assembly in the lamp of FIGS. 1A and 1B include another group of LEDs, wherein each LED, when illuminated, emits light having a dominant wavelength from 605 to 630 nm. In some embodiments LEDs in one group are packaged with a lumiphor. A lumiphor is a substance, which, when energized by impinging energy, emits light. Phosphor is an example of a lumiphor. In some cases, phosphor is designed to emit light of one wavelength when energized by being struck by light of a different wavelength, and so provides wavelength conversion. In the present example embodiment, one group of LEDs in LED assembly 102 is packaged with a phosphor which, when excited by light from the included LED, emits light having a dominant wavelength from 560 to 580 nm.

In the particular embodiment of FIGS. 1A and 1B, the first group of LED modules 140 is arranged in two strings with the second group of LED modules 142 arranged in a single string between the two strings. Also in this embodiment, the phosphor is included in modules 140. In this example, the phosphor is deposited on the encapsulating lens for each LED at such a thickness so that some of the light from the LED goes through the phosphor, while other light is absorbed and the wavelength is converted by the phosphor. Thus, each LED is packaged in a module 140 to form a blue-shifted yellow (BSY) LED device, while the light from each LED in modules 142 passes out of the LED module as red or orange (red/orange) light. Thus, substantially white light can be produced when two colors from the modules in the LED assembly are combined. Thus, this type of LED assembly may be referred to as a BSY+R LED assembly. In addition to a high color rendering index (CRI), light can be produced using an LED assembly like that above wherein the light in some embodiments has a correlated color temperature (CCT) from 2500K to 3500K. In other embodiments, the light can have a CCT from 2700K to 3300K. In still other embodiments, the light can have a CCT from about 2725K to about 3045K. In some embodiments, the light can have a CCT of about 2700K or about 3000K. In still other embodiments, where the light is dimmable, the CCT may be reduced with dimming. In such a case, the CCT may be reduced to as low as 1500K or even 1200K.

It should be noted that other arrangements of LEDs can be used with embodiments of the present invention. The same number of each type of LED can be used, and the LED packages can be arranged in varying patterns. A single LED of each type could be used. Additional LEDs, which produce additional colors of light, can be used. Lumiphors can be used with all the LED modules. A single lumiphor can be used with multiple LED chips and multiple LED chips can be included in one, some or all LED device packages. A further detailed example of using groups of LEDs emitting light of different wavelengths to produce substantially while light can be found in issued U.S. Pat. No. 7,213,940, which is incorporated herein by reference.

Turning now specifically to FIG. 1B, there is shown in this view a color mixing enclosure 150. An enclosure such as enclosure 150 is installed over the LED assembly to protect the LEDs and shield them from view. Such an enclosure may also be referred to as a dome, an optical enclosure, or an optical element. In this particular embodiment, enclosure 150 also provides color mixing so that color hot spots do not appear in the light pattern being emitted from the lamp. Such a color mixing optical element may be frosted, painted, etched, roughened, may have a molded-in pattern, or may be treated in many other ways to provide color mixing for the lamp. The enclosure may be made of glass, plastic, or some other material that passes light. The color mixing treatment imparts a particular transmittance-to-reflectance ratio to the enclosure, since some light is necessarily reflected and light reflected from one portion of the enclosure may eventually pass out of the lamp at some other portion of the enclosure. In some embodiments, the color mixing enclosure provides uniform transmittance-to-reflectance, usually because it includes a uniform color mixing treatment covering the entire exposed area.

Still referring specifically to FIG. 1B, enclosure 150 in the illustrated embodiment includes two sections with differing transmittance-to-reflectance ratios. Section 152 covers most of the dome and has one transmittance-to-reflectance ratio, and section 156 is disposed near the bottom of the dome, closer to LED assembly 102, and has a higher transmittance-to-reflectance ratio. Some of the light that is reflected from section 152 passes out of the lamp through section 156 of the enclosure. The differing transmittance-to-reflectance ratios in FIG. 1B are represented by different thicknesses of color treatment. However, if for example frosting or coating were to be used, these thicknesses are not drawn to scale but or drawn to clearly illustrate where the different sections of the enclosure are positioned in this example embodiment.

Embodiments of the invention can use varied fastening methods and mechanisms for interconnecting the parts of the lamp. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, or other fasteners may be used to fasten together the various components. In the example of FIGS. 1A and 1B, the optical enclosure includes a lip that rests in the space on the side of ridge 138 in the top of the heat sink. The optical enclosure can then be fastened in place with thermal epoxy. Other fastening methods can be used to fasten an optical enclosure to the other parts of the lamp. As examples, globes can be threaded and can screw into or onto the rest of the lamp. A tab and slot or similar mechanical arrangement could be used, as could fasteners such as screws or clips.

An LED lamp according to embodiments of the invention can be an "omnidirectional" lamp or a replacement for an omnidirectional incandescent bulb, in which case the LED lamp would necessarily also be substantially omnidirectional. The term "omnidirectional" as used herein is not intended to invoke complete or near complete uniformity of a light pattern in all directions. Rather, any pattern that avoids a completely dark area that might otherwise be present due to a mechanical mounting structure, electronics, or a heat sink could be said to be omnidirectional or substantially omnidirectional within the meaning of the term as used herein. In embodiments of the invention, some variation of light output around a lamp might be expected. However, Edison style LED lamps that are commonly referred to as "snow cones" because little light is given off below the horizontal plane for a vertically upright bulb would not be omnidirectional within the meaning of the term as used herein.

Figure 2:
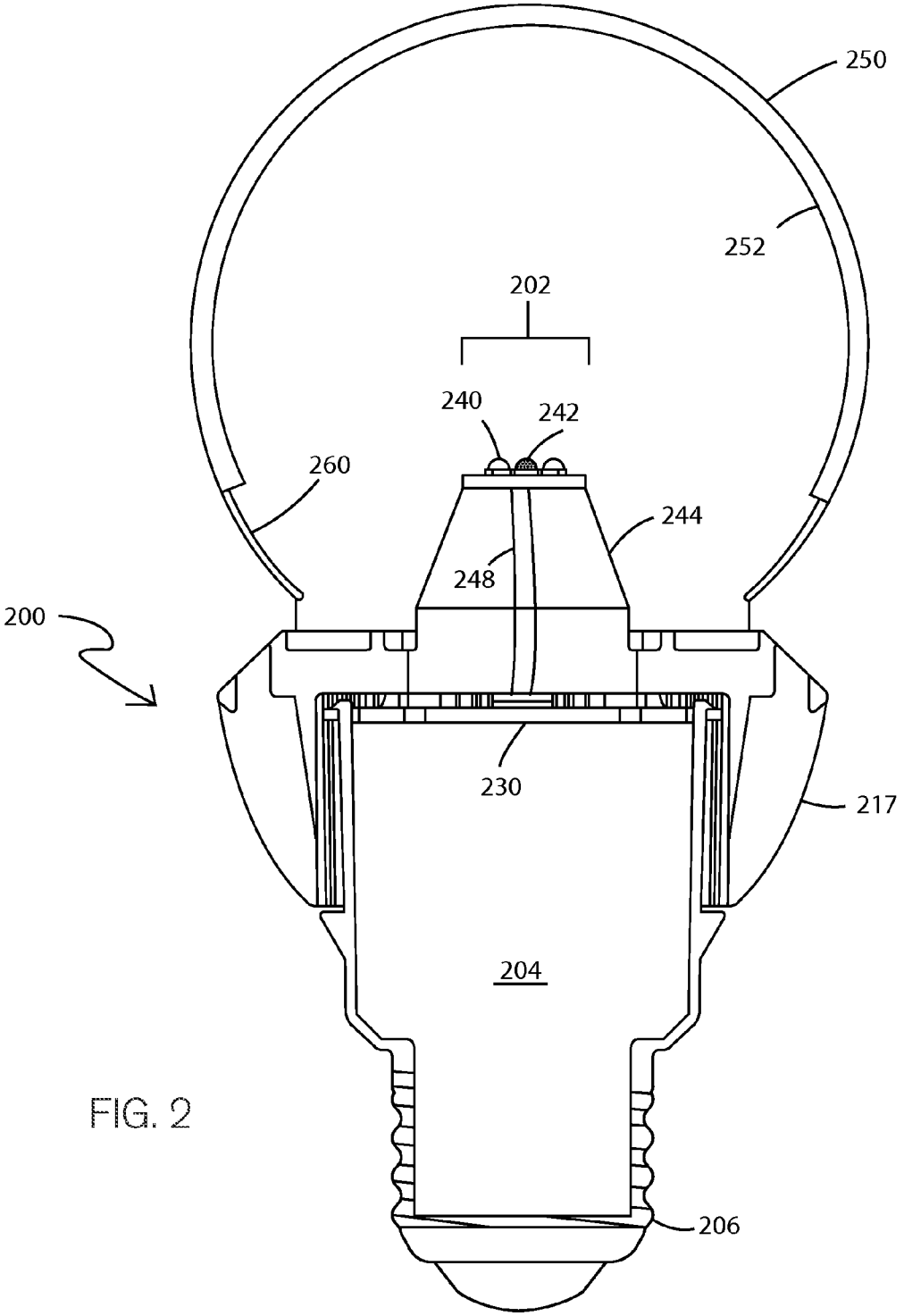
FIGS. 2, 3, 4, 5, 6, and 7 are cross-sectional views of LED lamps according to additional embodiments of the present invention.

FIG. 2 shows a side view of a lamp, 200, according to another embodiment of the present invention. FIG. 2 is shown in as a partial cross section. In the case of FIG. 2, LED assembly portion of the lamp, 202, has been interconnected with power supply portion 204 of the lamp. The power supply portion 204 of the lamp again includes a power supply consisting of circuitry to provide DC to the LED assembly. Again, the particular power supply portion of an LED lamp shown in FIG. 2 includes an Edison base, 206. The Edison base can engage with an Edison socket so that this example LED lamp can replace a standard incandescent bulb. The electrical terminals of the Edison base are connected to the power supply to provide AC power to the power supply.

Staying with FIG. 2, LED assembly 202 further includes multiple LED modules mounted on a carrier such as circuit board 212, which provides both mechanical support and electrical connections for the LEDs. Heat sink 217 is provided as before, as is a thermal isolation device, 230. Again, the heat sink design can vary. A heat sink may be used that has more extended curved fins, more or fewer fins, etc. A heat sink may be provided that has a more decorative appearance.

Still referring to FIG. 2, LED assembly 202 in this example embodiment again includes nine LED packages or LED modules, in which an LED chip is encapsulated inside a package with a lens and leads. Each LED module is mounted in circuit board 212. The LED modules include LEDs operable to emit light of two different colors. In this example embodiment, the LED modules on the LED assembly in the lamp of FIG. 2 include a group of LEDs, wherein each LED in module 240, when the LED is illuminated, emits light having dominant wavelength from 440 to 480 nm. The LED modules on the LED assembly in the lamp of FIG. 2 include another group of LEDs, wherein each LED in a module 242, when the LED is illuminated, emits light having a dominant wavelength from 605 to 630 nm. As before, LEDs in one group can be packaged with a lumiphor.

In the particular embodiment of FIG. 2, although the circuit board for the LEDs is smaller, the first group of LED modules 240 is again arranged in two strings with the second group of LED modules 242 arranged in a single string between the two strings. In this example, phosphor is again deposited on the encapsulating lens for each LED of the first group at such a thickness that some of the light from the LED goes through the phosphor, while other light is absorbed and the wavelength is converted by the phosphor to form a BSY+R LED assembly.

In FIG. 2, LED assembly 202 is mounted on support 244 as opposed to directly on a pedestal formed in the heat sink. The LED assembly can be fastened to the support with adhesive, or any of various fastening mechanisms as previously discussed. Support 244 is installed on the pedestal in this example, disposed between LED assembly 202 and the power supply. Support 244 in this example embodiment is a conical reflective surface, which serves to enhance the light output and light distribution of lamp 200. The surface of the conical reflective surface can be adjusted by setting the angle through altering the height and size and shape of the LED assembly or the base, and by surface treatment to adjust the reflectivity of the outer surface. Wires 248 pass through a void inside the conical reflective surface of lamp 200 and interconnect LED assembly 202 with the power supply.

Lamp 200 of FIG. 2 includes color mixing enclosure 250. In this particular embodiment, enclosure 250 provides color mixing in section 252 so that color hot spots do not appear in the light pattern being emitted from the lamp. This section of enclosure 250 may be frosted, painted, etched, roughened, may have a molded in pattern, or may be treated in many other ways to provide color mixing for the lamp. The enclosure may be made of glass, plastic, or some other material that passes light. The color mixing treatment imparts a particular transmittance-to-reflectance ratio to the enclosure, since some light is necessarily reflected and light reflected from one portion of the enclosure may eventually pass out of the lamp at some other portion of the enclosure. Enclosure 250 in the illustrated embodiment of FIG. 2 includes a substantially transparent section 260. Transparent section 260 is disposed opposite the conical reflective surface support 244 and allows some of the light reflected from section 252 to leave the lamp relatively unimpeded. By "substantially transparent" what is meant is that for light impinging on section 260 much more light is transmitted than is reflected. Such a section may be as transparent as can reasonably be achieved with normal manufacturing methods, such that it appears transparent to the eye, or it may appear translucent to the eye, notwithstanding the fact that its transmittance-to-reflectance ratio is different than that for the rest of the enclosure.

Figure 3:
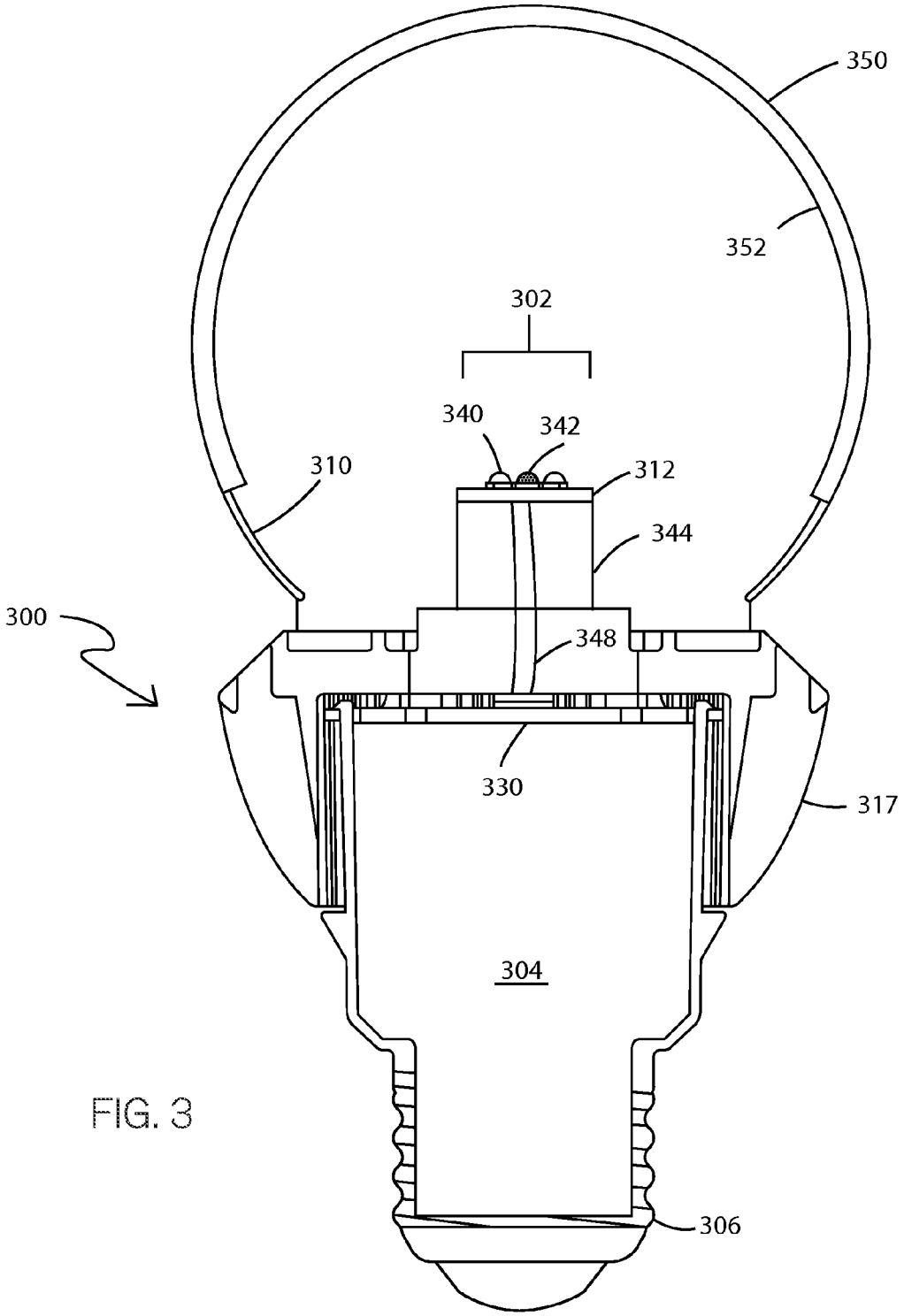

FIG. 3 shows a side view of a lamp, 300, according to another embodiment of the present invention. FIG. 3 is shown in as a partial cross section. In the case of FIG. 3, LED assembly 302 of the lamp has been interconnected with power supply portion 304 of the lamp. The power supply portion 304 of the lamp again includes a power supply consisting of circuitry to provide DC to LED assembly 302. Again, the particular power supply portion of an LED lamp shown in FIG. 3 includes an Edison base, 306. The Edison base can engage with an Edison socket so that this example LED lamp can replace a standard incandescent bulb.

Staying with FIG. 3, LED assembly 302 further includes multiple LED modules mounted on a carrier such as circuit board 312, which provides both mechanical support and electrical connections for the LEDs. Heat sink 317 is provided as before, as is a thermal isolation device, 330. Again, the heat sink design can vary. A heat sink may be used that has more extended curved fins, more or fewer fins, etc. A heat sink may be provided that has a more decorative appearance.

Still referring to FIG. 3, LED assembly 302 in this example embodiment again includes nine LED packages or LED modules, in which an LED chip is encapsulated inside a package with a lens and leads. Each LED module is mounted in circuit board 213. The LED modules include LEDs operable to emit light of two different colors. In this example embodiment, the LED modules on the LED assembly in the lamp of FIG. 3 include a group of LEDs, wherein each LED in a module 340, when the LED is illuminated, emits light having dominant wavelength from 440 to 480 nm. The LED modules on the LED assembly in the lamp of FIG. 3 include another group of LEDs, wherein each LED in a module 342, when the LED is illuminated, emits light having a dominant wavelength from 605 to 630 nm. As before, LEDs in at least one group can be packaged with a lumiphor.

In the particular embodiment of FIG. 3 the first group of LED modules 340 is again arranged in two strings with the second group of LED modules 342 arranged in a single string between the two strings. In this example, phosphor again can be deposited on the encapsulating lens or otherwise in or on the package for each LED of the first group at such a thickness that some of the light from the LED goes through the phosphor, while other light is absorbed and the wavelength is converted by the phosphor to form a blue-shifted yellow (BSY) LED module, which in turn forms a BSY+R LED assembly.

In FIG. 3, LED assembly 302 is mounted on support 344 as opposed to directly on a pedestal formed in the heat sink. The LED assembly can be fastened to the support with adhesive, or any of various fastening mechanisms as previously discussed. Support 344 is installed on the pedestal in this example, disposed between LED assembly 302 and the power supply. Support 344 in this example embodiment is a thermal post. Thermal post 344 can include an optically optimized outer surface, which may reflect, absorb, mix, or distribute light as needed to achieve the desired light distribution for LED lamp 300. The optically optimized outer surface can be obtained by forming or treating the outer surface of the thermal post, or by including a cylindrical component (not shown) around the thermal post. Wires 348 pass through a void inside the thermal post 344 of lamp 300 and interconnect LED assembly 302 with the power supply.

Lamp 300 of FIG. 3 again includes a color mixing enclosure. In this particular embodiment, enclosure 350 provides color mixing in section 352. This section of enclosure 350 may again be frosted, painted, etched, roughened, may have a molded in pattern, or may be treated in many other ways to provide color mixing for the lamp. The enclosure may be made of glass, plastic, or some other material that passes light. Enclosure 350 in the illustrated embodiment of FIG. 3 again includes a substantially transparent section 360 disposed opposite the thermal post support 344 and allows some of the light reflected from section 352 to leave the lamp relatively unimpeded.

Figure 4:
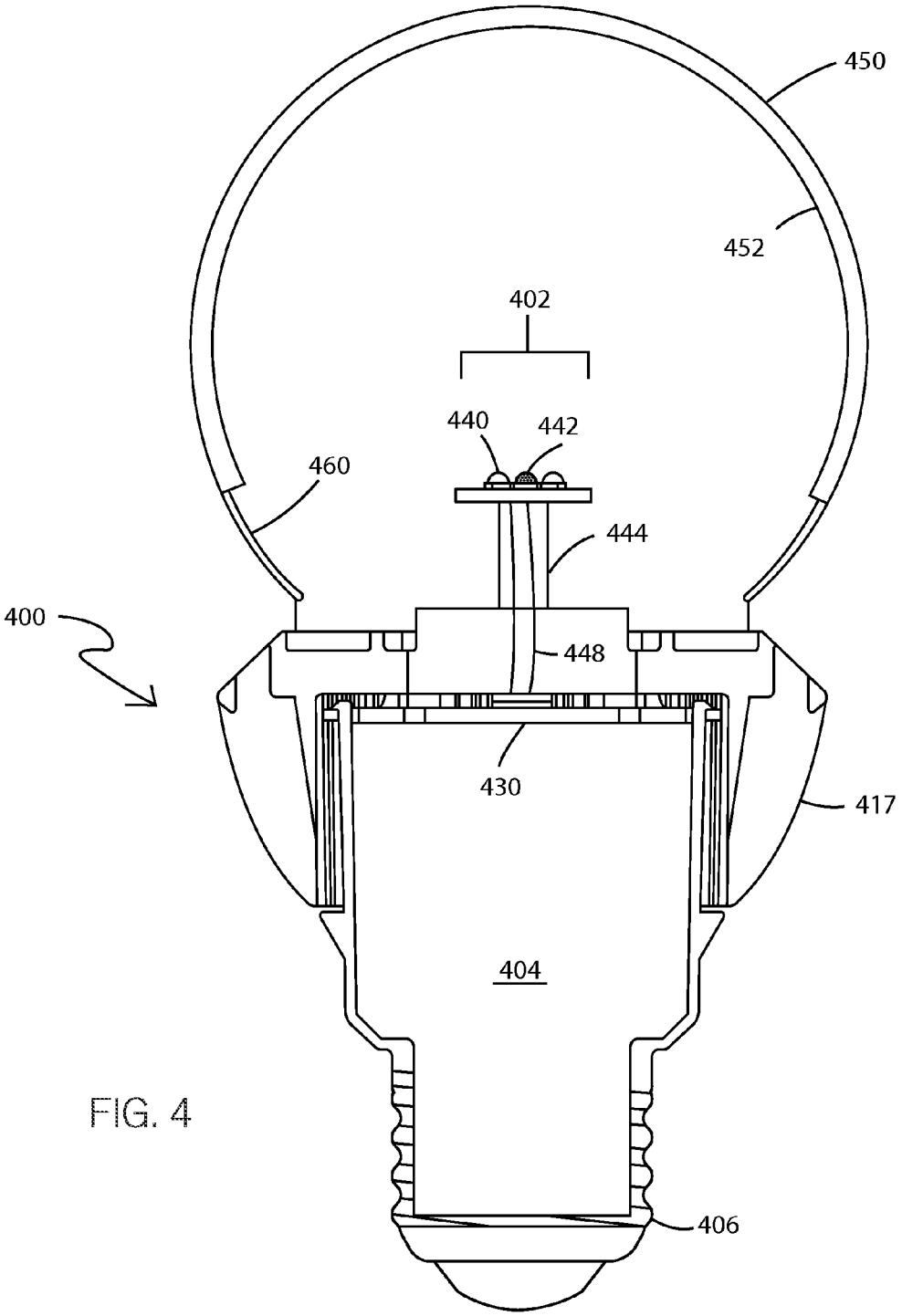

FIG. 4 shows a side view of lamp 400, an LED lamp according to another embodiment of the invention. FIG. 4 is shown in as a partial cross section. In FIG. 4, LED assembly 402 of the lamp is connected to power supply portion 404 of the lamp. The power supply portion 404 of the lamp again includes a power supply consisting of circuitry to provide DC to LEDs. Again, the particular power supply portion of an LED lamp shown in FIG. 4 includes an Edison base, 406. The Edison base can engage with an Edison socket so that this example LED lamp can replace a standard incandescent bulb.

LED assembly 402 of FIG. 4 again includes multiple LED modules mounted on circuit board 412, which provides both mechanical support and electrical connections for the LEDs. Heat sink 417 is provided as before, as is a thermal isolation device, 430. Again, the heat sink design can vary. A heat sink may be used that has more extended curved fins, more or fewer fins, etc. LED assembly 402 in the embodiment of FIG. 4 includes nine LED packages or LED modules, in which an LED chip is encapsulated inside a package with a lens and leads. The LED modules include LEDs operable to emit light of two different colors. In this example again, the LED modules on the LED assembly in the lamp of FIG. 4 can include a group of LEDs, wherein each LED in modules 440, when illuminated, emits light having dominant wavelength from 440 to 480 nm. The LED modules on the LED assembly in the lamp of FIG. 4 can also include another group of LEDs, wherein each LED in modules 442, emits light having a dominant wavelength from 605 to 630 nm. As before, LEDs in at least one group can be packaged with a lumiphor.

The LED modules in lamp 400 of FIG. 4 can be arranged in various ways, including with one group composed of two strings with the second group arranged in a single string between the two strings. In this example, phosphor again can be deposited on the encapsulating lens or otherwise in or on the package for each LED of the first group at such a thickness that some of the light from the LED goes through the phosphor, while other light is absorbed and the wavelength is converted by the phosphor to form a blue-shifted yellow (BSY) LED module.

Still referring to FIG. 4, LED assembly 402 is again mounted on a support 444. Support 444 is again installed on the pedestal in this example, disposed between LED assembly 402 and the power supply. However, support 444 in this example embodiment is a heat pipe. Heat pipe 444 can be used to conduct heat from the LED assembly to the heat sink, so that a large support need not be used for LED assembly 402. Wires 448 pass through a void inside the heat pipe 444 of lamp 400 and interconnect LED assembly 402 with the power supply. Lamp 400 again includes a color mixing enclosure. In this embodiment, enclosure 450 provides color mixing in section 452 as described before. Enclosure 450 also again includes a substantially transparent section 460 disposed opposite heat pipe 444. This transparent section allows some of the light reflected from section 452 to leave the lamp relatively unimpeded.

Figure 5:
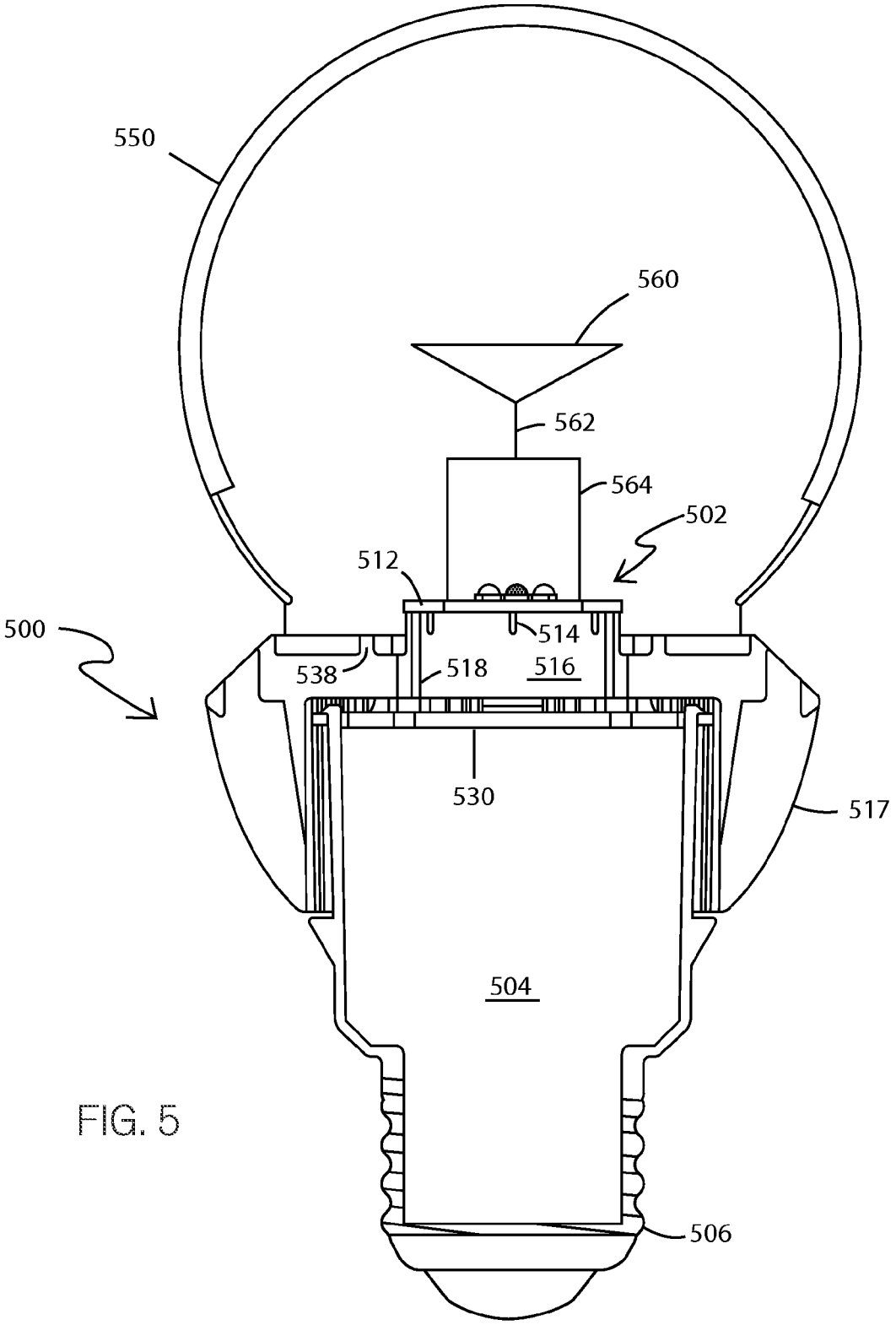

FIG. 5 shows a cross-sectional view of a lamp according to another embodiment of the invention. The lamp of FIG. 5 is externally very similar to the lamp of FIGS. 1A and 1B. Lamp 500 includes LED assembly 502 interconnected with power supply portion 504 of the lamp. The power supply portion 504 of the lamp includes a power supply consisting of circuitry (not visible) to provide DC current to an LED assembly.

The particular power supply portion of an LED lamp shown in FIG. 5 includes an Edison base, 506. The Edison base can engage with an Edison socket so that this example LED lamp can replace a standard incandescent bulb. Again, the particular physical appearance of the power supply portion and type of base included are examples only. Numerous types of LED lamps can be created using embodiments of the invention, with various types of bases, cooling mechanisms and shapes.

Staying with FIG. 5, LED assembly 502 further includes multiple LED modules mounted on a carrier such as circuit board 512, which provides both mechanical support and electrical connections for the LEDs. In the example embodiment of FIG. 5, the LED assembly is held in place with screws 514 that screw the LED assembly onto pedestal 516, which is formed in heat sink 517. Voids 518 in the sides of the pedestal allow wires from the power supply to be connected to LED assembly 502. In the case of FIG. 5, heat sink 517 has been interconnected with a thermal isolation device 530, which is in turn interconnected with power supply portion 504 of the lamp. Curved ridges 538 provide additional mechanical stability and define a space in which an optical enclosure for the lamp can rest.

Still referring to FIG. 5, enclosure 550 is installed over the LED assembly to protect the LEDs and shield them from view. Such an enclosure may also be referred to as a dome, an optical enclosure, or an optical element. In this particular embodiment, enclosure 550 also provides color mixing so that color hot spots do not appear in the light pattern being emitted from the lamp. Such a color mixing optical element may be frosted, painted, etched, roughened, may have a molded-in pattern, or may be treated in many other ways to provide color mixing for the lamp. The enclosure may be made of glass, plastic, or some other material that passes light. The color mixing treatment imparts a particular transmittance-to-reflectance ratio to the enclosure, since some light is necessarily reflected and light reflected from one portion of the enclosure may eventually pass out of the lamp at some other portion of the enclosure. In some embodiments, the color mixing enclosure provides uniform transmittance-to-reflectance, usually because it includes a uniform color mixing treatment covering the entire exposed area. In the embodiment of FIG. 5, enclosure 550 includes two sections with differing transmittance-to-reflectance ratios as previously described. The differing transmittance-to-reflectance ratios in FIG. 5 are represented by different thicknesses of color treatment. However, if for example frosting or coating were to be used, these thicknesses are not drawn to scale but or drawn to clearly illustrate where the different sections of the enclosure are positioned in this example embodiment.

The embodiment of FIG. 5 includes a cone reflector 560 disposed above the LED assembly within the enclosure. Cone reflector 560 can have either a specular or diffusive surface, and directs some of the light from the LEDs downward through the portion of dome 550 with a higher transmittance-to-reflectance ratio. Cone reflector 560 is supported over the LED assembly with mechanical supports 562 and 564, which can consist of an arrangement of wires or plastic posts, small enough so as not to have a significant impact on the light distribution from the LED assembly. Cone reflector 560 can be silvered or covered with enhanced specular reflector (ESR) film to achieve a specular surface, or can be made of white plastic or coated with white paint to achieve a diffusive or diffusive reflective surface. Cone reflector 560 can also be a semi-transparent specular surface, for example, by coating with dual brightness enhancement film (DBEF) or a semi-transparent diffusive reflective surface by coating with diffuser film.

Figure 6:
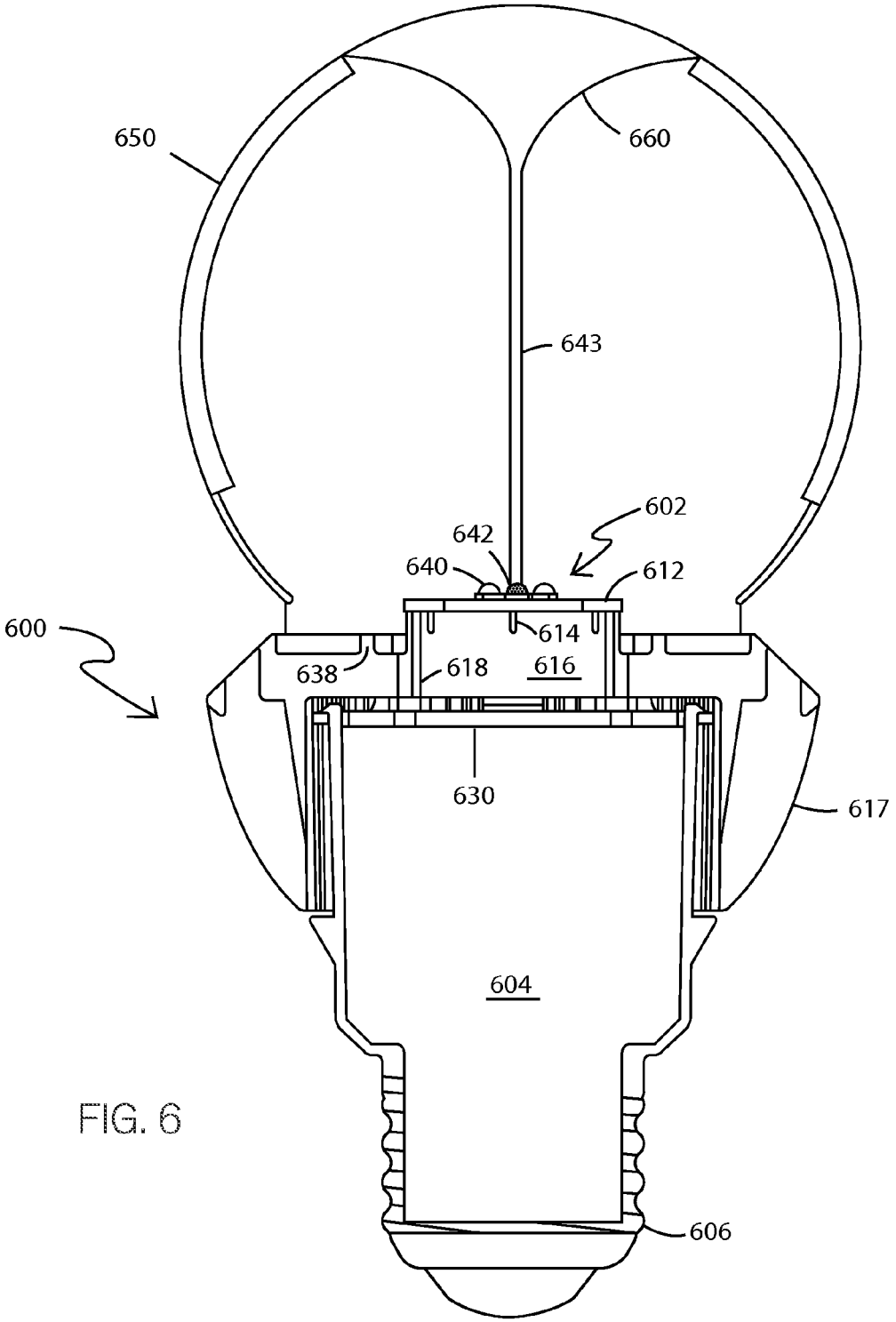

FIG. 6 shows a cross-sectional view of a lamp according to another embodiment of the invention. The lamp of FIG. 6 is again externally very similar to the lamp of FIGS. 1A and 1B. Lamp 600 includes LED assembly 602 interconnected with power supply portion 604 of the lamp. The power supply portion 604 of the lamp includes a power supply consisting of circuitry (not visible) to provide DC current to an LED assembly. In case of lamp 600, LED packages 640 and 642 are spread out in a pattern which allows a heat pipe, 643 to be secured in the center of the LED assembly. The LED package that was previously in the middle of the array of LEDs may be omitted, and appropriate adjustments may be made to the wavelengths, power, packaging, etc. of the other LEDs to compensate. Heat pipe 643 may be secured to the LED assembly with fasteners, glue or another adhesive, or in any other fashion.

Again, the power supply portion of an LED lamp shown in FIG. 6 includes an Edison base, 606. LED assembly 602 further includes multiple LED modules mounted on a carrier such as circuit board 612, which provides both mechanical support and electrical connections for the LEDs. The LED assembly is held in place with screws 614 that screw the LED assembly onto pedestal 616, which is formed in heat sink 617. Voids 618 in the sides of the pedestal allow wires from the power supply to be connected to LED assembly 602. Heat sink 617 has been interconnected with a thermal isolation device 630, which is in turn interconnected with power supply portion 604 of the lamp. Curved ridges 638 provide additional mechanical stability and define a space in which an optical enclosure for the lamp can rest.

Staying with FIG. 6, enclosure 650 is installed over the LED assembly to protect the LEDs and shield them from view. Such an enclosure may also be referred to as a dome, an optical enclosure, or an optical element. In this particular embodiment, enclosure 650 also provides color mixing so that color hot spots do not appear in the light pattern being emitted from the lamp. Such a color mixing optical element may be frosted, painted, etched, roughened, may have a molded-in pattern, or may be treated in many other ways to provide color mixing for the lamp. The enclosure may be made of glass, plastic, or some other material that passes light. In the embodiment of FIG. 6, enclosure 650 includes two sections with differing transmittance-to-reflectance ratios as previously described.

The embodiment of FIG. 6 includes a cone reflector 660 disposed above the LED assembly, in this case formed as the top of heat pipe 643. Cone reflector 660 can again have either a specular or diffusive surface, and directs some of the light from the LEDs downward through the portion of dome 650 with a higher transmittance-to-reflectance ratio. Cone reflector 660, can be silvered to achieve s specular surface, or can be made of white plastic or coated with white paint to achieve a diffusive or diffusive reflective surface. Cone reflector 660 can also be a semi-transparent specular surface or a semi-transparent diffusive reflective surface by coating with diffuser film. Enclosure 650 of lamp 600 may be open on top so that heat from the heat pipe is vented without obstruction through the top of the enclosure, optionally using the full diameter of the wide end of the cone reflector. Alternatively, the enclosure or an additional part can cover the wide end of the cone reflector where there would be enough heat transfer through the surface of the covering. The cone reflector and the heat pipe can be molded or otherwise formed as part of the enclosure, or exist as a separate part.

Figure 7:
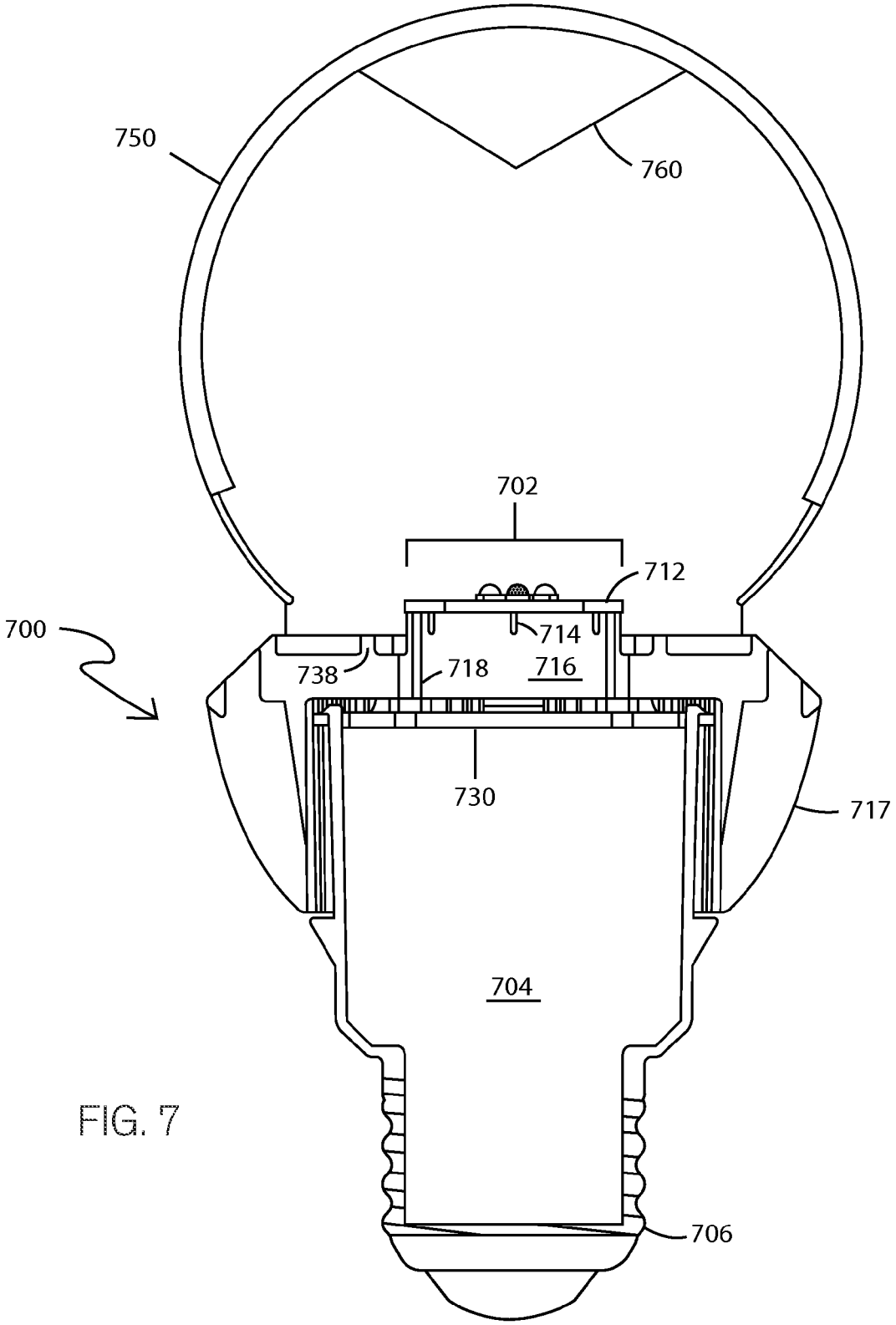

FIG. 7 shows a cross-sectional view of a lamp according to another embodiment of the invention. The lamp of FIG. 7 is again externally very similar to the lamp of FIGS. 1A and 1B. Lamp 700 includes LED assembly 702 interconnected with power supply portion 704 of the lamp. Again, the power supply portion of an LED lamp shown in FIG. 7 includes an Edison base, 706. LED assembly 702 further includes multiple LED modules mounted on a carrier such as circuit board 712, which provides both mechanical support and electrical connections for the LEDs. The LED assembly is held in place with screws 714 that screw the LED assembly onto pedestal 716, which is formed in heat sink 717. Voids 718 in the sides of the pedestal allow wires from the power supply to be connected to LED assembly 702. Heat sink 717 has been interconnected with a thermal isolation device 730, which is in turn interconnected with power supply portion 704 of the lamp. Curved ridges 738 provide additional mechanical stability and define a space in which an optical enclosure for the lamp can rest.

Staying with FIG. 7, enclosure 750 is installed over the LED assembly to protect the LEDs and shield them from view. Such an enclosure may also be referred to as a dome, an optical enclosure, or an optical element. In this particular embodiment, enclosure 750 also provides color mixing so that color hot spots do not appear in the light pattern being emitted from the lamp. Such a color mixing optical element may be frosted, painted, etched, roughened, may have a molded-in pattern, or may be treated in many other ways to provide color mixing for the lamp. The enclosure may be made of glass, plastic, or some other material that passes light. In the embodiment of FIG. 7, enclosure 750 includes two sections with differing transmittance-to-reflectance ratios as previously described.

The embodiment of FIG. 7 includes a cone reflector 760 disposed above the LED assembly. In the case of lamp 700, the cone reflector is fixed to the optical dome. This can be accomplished with glue, fasteners, clips, or in any other fashion. Cone reflector 760 can again have either a specular or diffusive surface, and directs some of the light from the LEDs downward through the portion of dome 750 with a higher transmittance-to-reflectance ratio. Cone reflector 760, can be silvered to achieve s specular surface, or can be made of white plastic or coated with white paint to achieve a diffusive or diffusive reflective surface. Cone reflector 760 can also be a semi-transparent specular surface or a semi-transparent diffusive reflective surface by coating with diffuser film.

Figure 8:
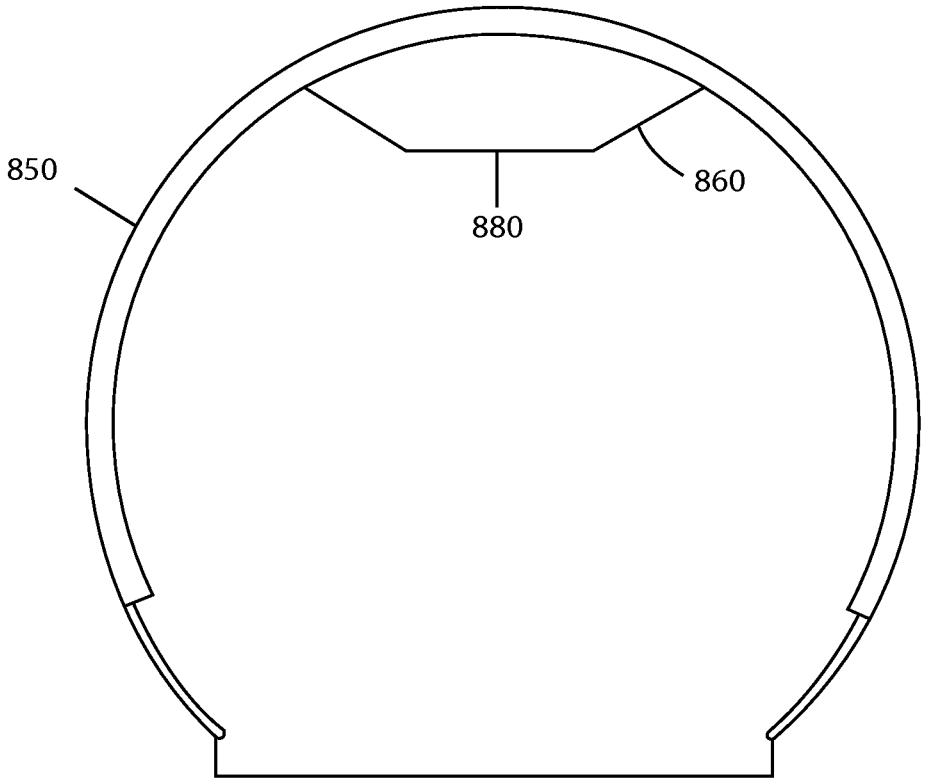
FIGS. 8 and 9 are cross-sectional views of the optical enclosure for LED lamps of additional embodiments of the present invention.
Figure 9:
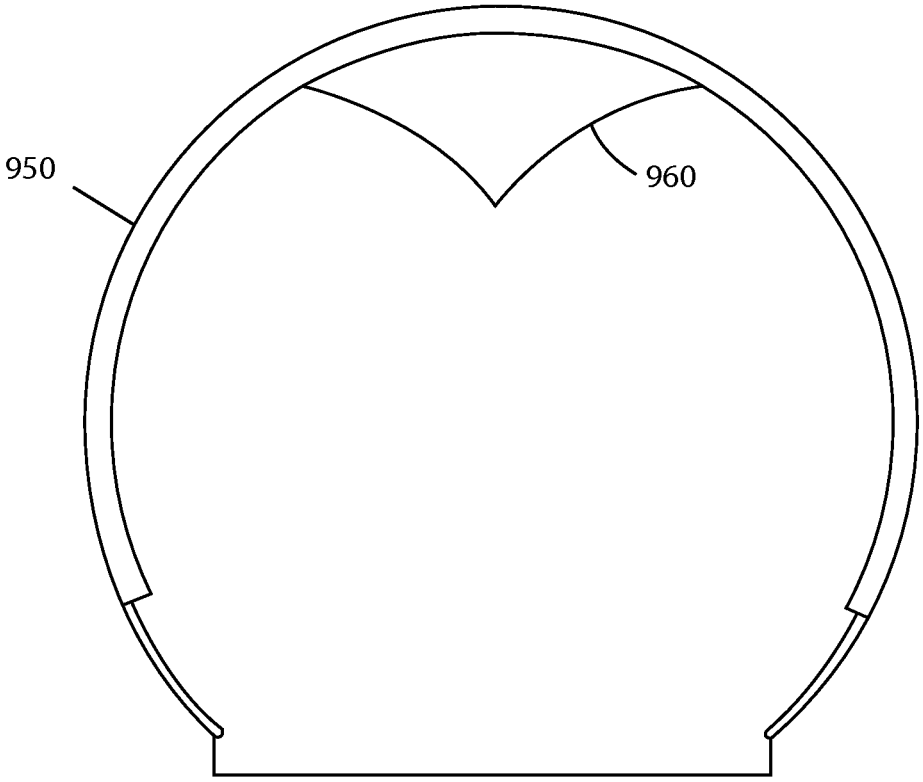

FIG. 8 is a cross-sectional view of a dome enclosure 850 for a lamp according to another embodiment of the invention. The lamp can be the same or similar to any of those previously described. Dome 850 again includes a cone reflector, 860, which in this case forms a truncated cone, the apex being cut off. Opening 880 in cone reflector 860 can be completely open or can be covered with a transparent diffuser, specular surface, or any of the other types of surfaces previously discussed with respect to cone reflectors. FIG. 9 is a cross-sectional view of another dome enclosure 950 for a lamp according to another embodiment of the invention. The lamp can be the same or similar to any of those previously described. Dome 950 again includes a cone reflector, 960, which in this case includes a curved outer surface instead of a straight surface, although for purposes of this disclosure it can still be referred to as a cone reflector. Cone reflector 960 can be made like the previously described cone reflectors in all other respects.

Features of the various embodiments of the LED lamp described herein can be adjusted and combined to produce an LED lamp that has various characteristics, including, in some embodiments, a lamp that meets or exceeds one or more of the product requirements for the L prize. For example, the lamp may have a CRI of about 80 or more, 85 or more, 90 or more, or 95 or more. The lamp may have a luminous efficacy of at least 100 lumens per watt, at least 90 lumens per watt, at least 75 lumens per watt, or at least 50 lumens per watt. The lamp may consume less than or equal to 10 watts of power, or less than or equal to 13 watts of power. The lamp may have color spatial uniformity where the variation of chromaticity in different directions shall be within 0.004 from the weighted average point of a standard, CIE 1976 (u',v') diagram. The lamp may have a luminous intensity distribution that varies by not more than 5% or not more than 10% from 0 to 150 degrees as measured from the top of the color mixing enclosure. In some embodiments, the lamp may have a luminous intensity distribution that varies by not more than 20% from 0 to 135 degrees measured this way. In some embodiments, the lamp has a luminous intensity distribution that varies by not more than 30% from 0 to 120 degrees measured from the top of the enclosure. The lamp may also have a 70% lumen maintenance lifetime of at least 25,000 hours, and may have at least 5% of its total flux in the 135-180 degree zone.

In some embodiments, the LED lamp may conform to the product requirements for light output, wattage, color rendering index, CCT, dimensions and base type of a 60-watt incandescent replacement for the L prize. In some embodiments, the LED lamp conforms to the product requirements for luminous efficacy, color spatial uniformity, light distribution, color rendering index, dimensions and base type of a 60-watt incandescent replacement for the L prize. In some embodiments, the LED lamp may conform to all or a majority the product requirements for a 60-watt incandescent replacement for the L prize.

Measurements of color and/or angular uniformity, in some embodiments, are taken in the near field of the lamp. In other embodiments, the measurements may be taken in the far field of the bulb. The L prize specification regarding angular uniformity of light from an LED lamp is not the only such specification in use. In the United States, the Energy Star™ program, run jointly by the U.S. Environmental Protection Agency and the U.S. Department of Energy promulgates a standard for integrated LED lamps, the *Energy Star Program Requirements for Integral LED Lamps*, amended Mar. 22, 2010, which is incorporated herein by reference. Measurement techniques for both color and angular uniformity are described in the Energy Star Program Requirements. For a vertically oriented lamp, luminous intensity is measured in vertical planes 45 and 90 degrees from an initial plane. It shall not differ from the mean intensity by more than 20% for the entire 0-135 degree zone for the lamp, with zero defined as the top of the envelope. Additionally, 5% of the total flux from the lamp shall be in the 135-180 degree zone.

It should be noted that in at least some embodiments of the invention, light passes from the LED assembly through the enclosure without wavelength conversion. By this terminology, what is meant is that there is no "remote" wavelength conversion, such as a remote lumiphor or phosphor, employed in the lamp. As an example, in such an embodiment there is no internal phosphor dome enclosing the LED assembly and a lumiphor is not used on the external color mixing enclosure. Such terminology is not intended to suggest that there is no lumiphor or phosphor anywhere in the lamp, however. As previously discussed, a lumiphor can be used in LED packages, or otherwise included as part of the LED assembly. Such a lumiphor would not be considered remote wavelength conversion in the context of this disclosure.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. Additionally, comparative, quantitative terms such as "less" and "greater", are intended to encompass the concept of equality, thus, "less" can mean not only "less" in the strictest mathematical sense, but also, "less than or equal to."

It should also be pointed out that references may be made throughout this disclosure to figures and descriptions using terms such as "above", "top", "bottom", "side", "within", "on", and other terms which imply a relative position of a structure, portion or view. These terms are used merely for convenience and refer only to the relative position of features as shown from the perspective of the reader. An element that is placed or disposed atop another element in the context of this disclosure can be functionally in the same place in an actual product but be beside or below the other element relative to an observer due to the orientation of a device or equipment. Any discussions which use these terms are meant to encompass various possibilities for orientation and placement.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. An LED lamp comprising:

an LED assembly further comprising at least first and second LED device packages that emit light of at least two different colors; and an optical enclosure around the LED assembly to form a replacement for a standard incandescent bulb or fluorescent lamp, the optical enclosure comprising at least first and second sections that are different;

wherein the optical enclosure and the LED assembly are configured so that light from the LED assembly passes through the optical enclosure without conversion by a lumiphor outside of the LED device packages and is emitted from the lamp with a correlated color temperature (CCT) from 2500K to 3500K and a color rendering index (CRI) of at least 90.

2. The LED lamp of claim 1 wherein at least one of the first and second sections of the optical enclosure further comprise a color mixing treatment.

3. The LED lamp of claim 1 wherein the first and second sections of the optical enclosure have different reflective properties.

4. The LED lamp of claim 1 wherein the LED lamp is configured to reduce correlated color temperature with dimming to as low as 1200K.

5. The LED lamp of claim 1 wherein at leas some of the LED device packages include a lumiphor.

6. The LED lamp of claim 5 operable with a luminous efficacy of at least 75 lumens per watt.

7. The LED lamp of claim 1 wherein, when the lamp is energized, the first section of the optical enclosure reflects at least some light to the second section of the optical enclosure such that light exits the LED lamp in a substantially omnidirectional pattern.

8. An LED lamp comprising an LED assembly including at least two groups of LED device packages that emit light of at least two different colors, and further comprising an optical enclosure around the LED assembly to form a substantially omnidirectional replacement for a standard incandescent light bulb, the optical enclosure comprising at least first and second sections, the second section being closer to the LED assembly;

wherein, when the lamp is energized, the first section of the optical enclosure reflects at least some light to the second section of the optical enclosure such that light exits the LED lamp in a substantially omnidirectional pattern and so that light from the LED assembly is emitted through the optical enclosure without conversion by a lumiphor outside of the LED device packages and with a correlated color temperature (CCT) from 2500K to 3500K and a color rendering index (CRI) of at least 90.

9. The LED lamp of claim 8 wherein first LEDs in one group of LED device packages, if illuminated, would emit light having a dominant wavelength from 440 to 480 nm, and second LEDs in a second group of LED device packages, if illuminated, would emit light having a dominant wavelength from 605 to 630 nm, at least some of the LED device packages including a lumiphor.

10. The LED lamp of claim 9 wherein the lumiphor, when excited, emits light having a dominant wavelength from 560 to 580 nm.

11. The LED lamp of claim 8 wherein the LED lamp is operable to reduce the correlated color temperature with dimming to as low as 1200K.

12. The LED lamp of claim 8 wherein the optical enclosure comprises a dome, and the first and second sections extend around the dome.

13. The LED lamp of claim 8 further comprising an Edison base and wherein the optical enclosure around the LED assembly form a replacement for an A-shaped incandescent bulb.

14. The LED lamp of claim 13 operable at a luminous efficacy of at least 75 lumens per watt.

15. A method of making an LED lamp comprising:

providing at least first and second LED device packages operable to emit light of two different colors, at least some of the LED device packages including a lumiphor to produce an LED assembly that can provide light with a correlated color temperature (CCT) from 2500K to 3500K and a color rendering index (CRI) of at least 90; and installing an optical enclosure around the LED assembly to form a replacement for a standard incandescent light bulb, the optical enclosure being without a lumiphor outside of the LED device packages and comprising at least first and second sections that are different, so that at least some light emitted by the LED assembly when the lamp is energized exits the LED lamp in a substantially omnidirectional pattern.

16. The method of claim 15 further comprising installing a power supply in the power supply portion to enable the LED lamp.

17. An LED lamp made according to the method of claim 16 wherein the LED lamp is operable to reduce the correlated color temperature with dimming to as low as 1200K.

18. An LED lamp made according to the method of claim 16 wherein the LED lamp is operable with a luminous efficacy is at least 75 lumens per watt.

19. The method of claim 16 wherein providing at least first and second LED device packages comprises providing first LEDs in the first LED device packages that, if illuminated, would emit light having a dominant wavelength from 440 to 480 nm, and second LEDs in the second LED device packages, if illuminated, would emit light having a dominant wavelength from 605 to 630 nm, wherein some of the first and second LED device packages include a lumiphor, which, when excited, emits light having a dominant wavelength from 560 to 580 nm.

20. An LED lamp made according to the method of claim 16 wherein the LED lamp is operable to emit light with a CCT from 2700K to 3300K.

* * * * *